US005252059A

United States Patent [19]

May

[11] Patent Number: 5,252,059

[45] Date of Patent: Oct. 12, 1993

[54] PROCESS FOR THE LOW-EMISSION COMBUSTION OF FUEL, AND BURNER FOR USE IN SAID PROCESS

[76] Inventor: Michael G. May, Rte. de Gentéve, CH-1180 Rolle, Switzerland

[21] Appl. No.: 886,781

[22] Filed: May 21, 1992

[30] Foreign Application Priority Data

May 24, 1991 [CH] Switzerland ..... 01547/91-0

[51] Int. Cl.[5] ..... F23M 3/00

[52] U.S. Cl. ..... 431/9; 431/116; 431/75; 431/351

[58] Field of Search ..... 431/9, 115, 116, 351, 431/352, 75

[56] References Cited

U.S. PATENT DOCUMENTS 3,923,251 12/1975 Flournoy ..... 431/351
4,473,349 9/1984 Kumatsu ..... 431/116
4,575,332 3/1986 Oppenberg et al. ..... 431/116

FOREIGN PATENT DOCUMENTS 8909288 11/1989 Fed. Rep. of Germany .
3821526 12/1989 Fed. Rep. of Germany .
3906854 10/1990 Fed. Rep. of Germany .
8601876 3/1986 World Int. Prop. O. .

*Primary Examiner*—Carroll B. Dority
*Attorney, Agent, or Firm*—Ostrolenk, Faber, Gerb & Soffen

[57] ABSTRACT

The process for the continuous combustion of fluid fuel, for example fuel oil or gas, comprises the flow of several air jets through the opening of a screen, these air jets being arranged in such a manner that a multidimensional layering of mixtures of fuel, recirculated flue gas and air in the axial, radial, and circumferential directions is obtained within a fire tube. In this manner, the amount of noxious combustion products is reduced to values which are lower than the most severe emission limits in the world, namely the Swiss pollution standards.

20 Claims, 3 Drawing Sheets

Figure 1:
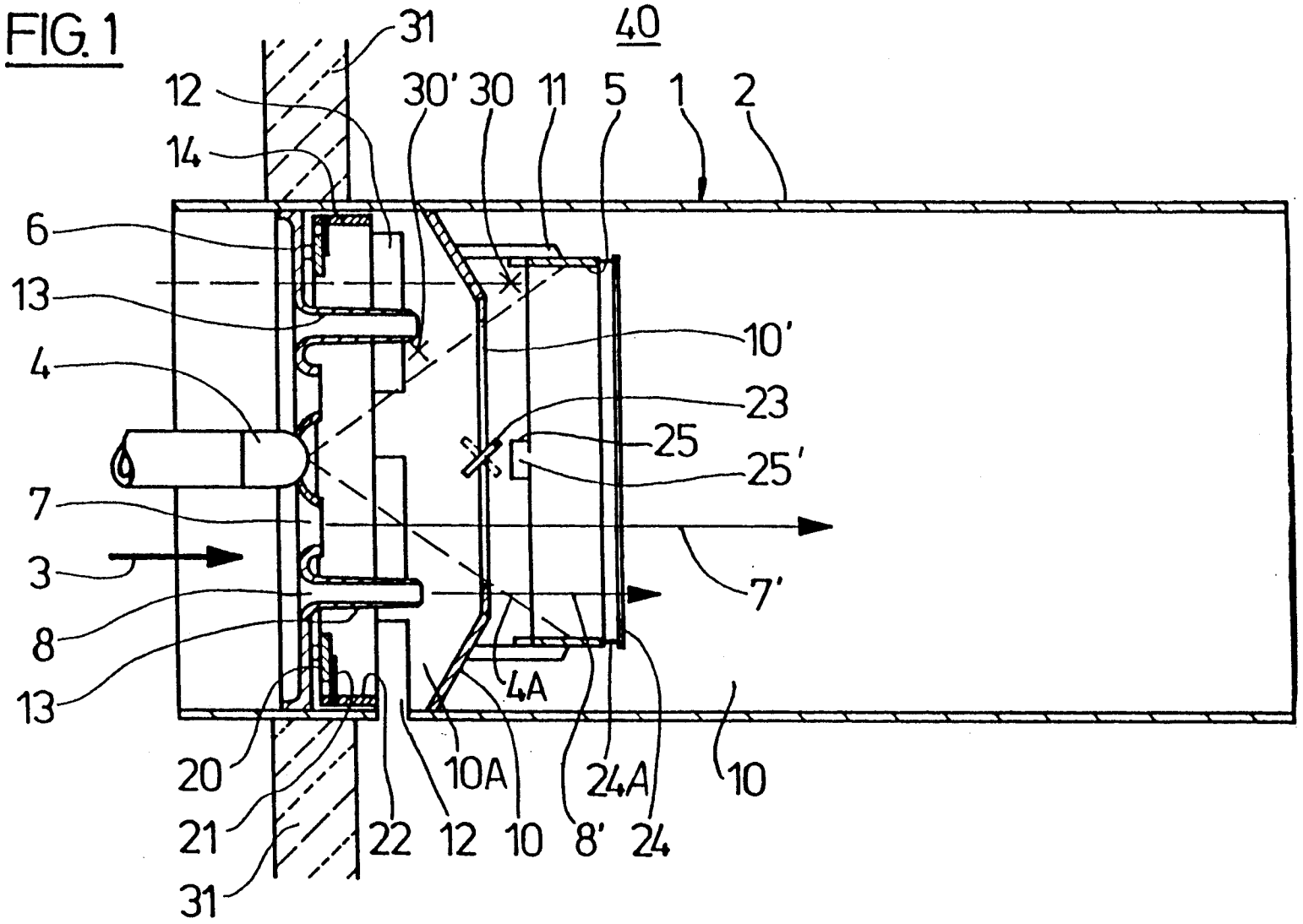

PROCESS FOR THE LOW-EMISSION COMBUSTION OF FUEL, AND BURNER FOR USE IN SAID PROCESS

This invention belongs to the field of combustion. It is particularly related to a process for the continuous combustion of fluid fuels by air in a blast burner having a burner head comprising a fire tube, fuel supply means, and ignition means, at least an essential part of the combustion air being supplied to said burner head in the form of air jets through a nozzle plate within said fire tube which generates said air jets, this arrangement producing at least one low-pressure region in said fire tube which is capable of aspirating flue gases and/or combustion end products from the atmosphere surrounding said fire tube, in the manner of an injector pump.

The invention is furthermore related to an apparatus for use in this process.

A process as described above is generally disclosed in WO 86/01867, on Mar. 27, 1986, to the inventor.

Furthermore, a process and a device for the combustion of fuel are known from DE-A1-3821526, wherein the fuel, namely a mineral oil, is reformed and cracked in the initial zone of the combustion space by hot flue gases.

For the combustion of fuels for the production of thermal energy, for example for the heating of buildings, but also in power plants, the fuel, for example fuel oil, natural gas, coal dust, coal granulate, etc., is supplied into an air stream within a so-called burner head. The air stream is supplied to the burner head by a fan, and the fuel is ignited by electrodes or an ignition flame and burnt within the air stream.

It is further known that noxious matter and pollutants are produced when gaseous and liquid fuels, for example petrol, natural gas, petrol and natural gas fractions, are burnt in air, which process is being conducted for the direct or indirect energy production on a large scale.

It is a significant and important object of the invention to provide a combustion process and an apparatus for carrying out the same which bring about a substantial reduction of the amounts of pollutants in the flue gas.

A further object of the invention is to provide a process and an apparatus of this kind providing a reliable operation.

A further object of the invention is a simplified construction of the apparatus, thus allowing a simple and correct maintenance even by non-specialised personnel.

The invention is further directed to the realisation of said process and apparatus under the best cost-efficiency conditions.

In order to implement these objects and aims, the process of this invention, as already described above, contemplates to stabilize a flow pattern based on said low pressure in the fire tube by a screen mounted therein, and whose passage area is greater than the sum of all passage areas of said nozzles. The injected fuel is directed in such a manner that it does not impinge directly upon the surfaces of the screen facing the burner head, and flue gas is aspirated into the space upstream of the screen from the space surrounding the fire tube. A temperature-dependent control of the opening areas which are provided in the wall of the burner head by movable closure means allows the desired adaptation of the amount of recirculated flue gases in response to their temperature, this control possibility being desirable also during the starting phase of the burner procedure in order to obtain a stable configuration of the flame. Furthermore, said air jets are arranged in such a manner that a multidimensional layering of fuel, recirculated flue gas and air in an axial, radial and circumferential manner is obtained in the fire tube.

The process of the invention allows to fulfill the most severe emission limits of the world, namely the Swiss pollution standards. This is already reached by merely replacing the burner heads of conventional blast burners by the burner head of this invention, possibly accompanied by an adaptation of the fuel distribution thereto, which constitutes a most economical solution.

The diameters of the air jets in the central zone of the burner are preferably greater than those in the peripheral region, the jet lengths of the air jets thereby being advantageously adapted and the central region having greater free jet lengths, resulting in a desired elongation of the flame. This contributes to a reduction of nitrous oxide formation.

The process of the invention allows to burn all flowable, i.e. fluid fuels, including fuels which can be brought into a flowable form. This can be achieved by mixing solid, finely divided fuels with a free-flowing and possibly even inert material, for example coal dust together with air or flue gas, coal dust together with fuel oil, etc.

Figure 2:
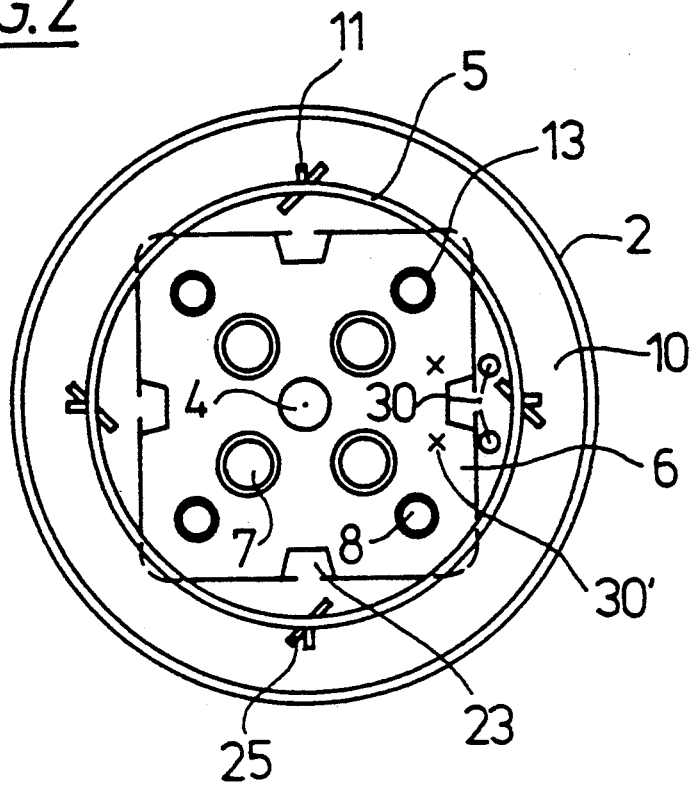
Figure 3:
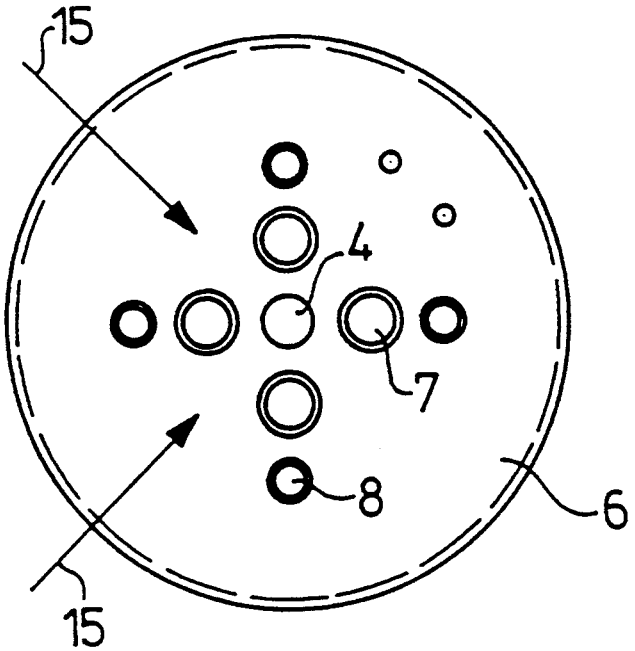
Figure 4:
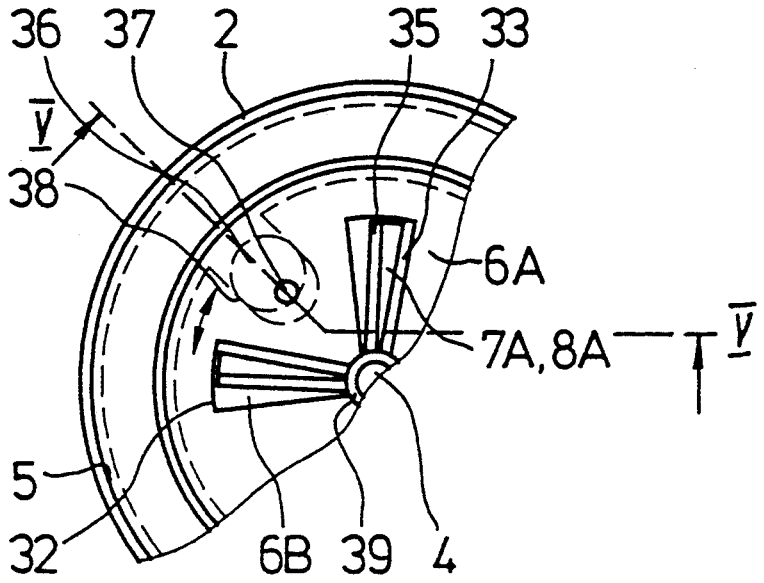
Figure 5:
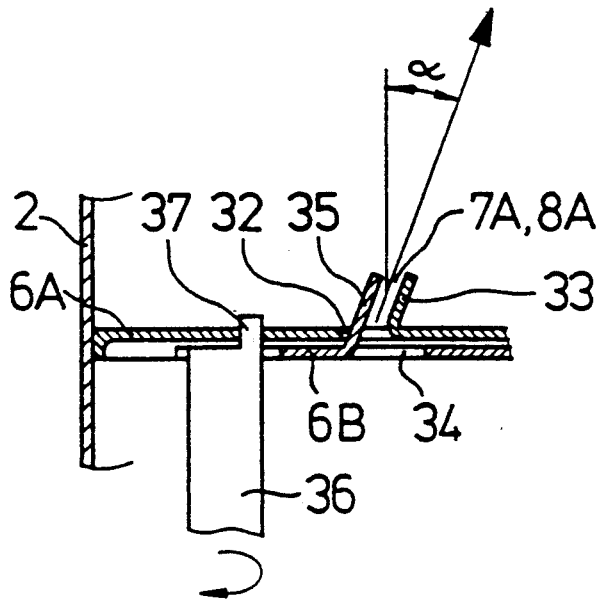

The invention will now be further explained by the description of embodiments of apparatus according to the invention. The description will also involve an explanation of the process of the invention. Reference is further made to the drawing, wherein:

FIG. 1 represents an axial section of a burner head of the invention;

FIG. 2 a front view of the burner head of FIG. 1;

FIG. 3 a front view of a nozzle plate;

FIG. 4 a partially cutoff front view of another burner head of the invention; and FIG. 5 a section in the plane according to line V—V in FIG. 4.

FIGS. 1–5 are schematical representations; the constructive details of realisations may differ from the drawing.

FIG. 1 is a schematic that illustrates an axial section of a burner head 1 together with its fire tube 2. Burner head 1 is mounted in an appropriate opening in a wall 31 of a combustion space 40 for example of a heating furnace. The interior of the combustion space 40 is located on the right side of wall 31 in FIG. 1. Arrow 3 shows the entrance of the combustion air which is supplied by a fan (not shown). Fuel is supplied in a manner known per se from the same side, as the air said fuel being e.g. a liquid fuel which is pulverised in whirl nozzle 4. As it can be seen in FIG. 1, the fuel which has been atomized by the nozzle 4 forms essentially a cone whose borderlines are represented by dashed lines 4A. The border portions of this cone will impinge on the inner surfaces of a splash ring 5 which is generally shaped as a cylinder coaxial to the fire tube 2. The splash ring 5 is fixed by a number of supports 11 to a screen 10 which will be described later. Two of these supports 11 are shown in FIG. 1. The splash ring 5 hinders the fuel from impinging on the inner surface of the fire tube 2. The fuel portions which have been intercepted by the splash ring 5 are evaporated and/or gasified on the splash ring.

A nozzle plate 6 is vertically, i.e. in radial direction, mounted in the upstream end portion of the fire tube 2. This nozzle plate 6 serves to limit the volume of the combustion air to enter into the fire tube 2, and to distribute this air in a specially desired manner. nozzle plate 6 has greater openings 7 and smaller openings 8 which divide the supplied combustion air into several individual jets which are indicated by arrows 7' and 8'. The openings 8 are prolongated by adjoining pipe sockets 13. Downstream of nozzle plate 6, a screen 10 is mounted substantially perpendicularly to the longitudinal axis of the fire tube 2. In FIG. 1, the screen 10 has a slightly conical shape. The screen 10 has a central opening 10'. It is important that the open area 10' of screen 10 is greater than the sum of all areas formed by openings 7 and 8 in nozzle plate 6 but obviously smaller than the cross sectional area of the fire in tube 2. Furthermore, 10' has such a shape and size that the fuel jet coming from in nozzle 4 does not impinge on the surface portions of screen 10. Spark gaps X of non-represented igniting electrodes lie in region 30. Another position of spark gap is shown by electrodes 30' which will be put in action during the starting phase of the burner. The downstream surface of the screen 10 bears supports 11 which support, as it has already been mentioned above, the splash ring 5. Fire tube 2 further comprises slot-like openings 12 in the wall of the fire tube 2 adjacent the wall 31 but within the combustion chamber 40, and closure means 14 for said openings 12. Flue gas from the combustion space can enter into fire tube 2 in controllable amounts through openings 12. In providing the screen 10 described above, the interior of the fire tube is divided into two working sections 10A (upstream of the screen) and 10B (downstream of the screen). During operation of the burner of the invention, the main flame develops downstream of the screen in zone 10B, and the hot combustion gases which are produced are hindered by the screen 10 from penetrating into the mixing zone 10A where air, fuel and recirculated flue gas, whose amount is controlled by the closure or the opening of the slots 12, are appropriately mixed by an injector pump-like action of the nozzles 7 and 13. Thus, the flue gases produced within the working zone 10B leave first totally the fire tube and deliver their thermal energy to the devices to be heated, and only than a portion of them is recirculated into the burner.

In the absence of the screen 10, an uncontrollable and unstable flow pattern composed of fresh air, fuel, and flue gases, would be generated in the fire tube 2, and such a combustion would be unstable and noisy and would produce a relatively high level of noxious gases.

In order to control the amount of flue gas through the openings 12, a ring 14 (already mentioned above as a closure means), is secured to individual bimetal strips 20 by pins 21, said bimetal strips 20 being fixedly connected to nozzle plate 6 by their ends opposite pins 21. The ring 14 is slidably inserted into the fire tube 2 and is able to reciprocate within said tube. In the starting phase of the burner openings 12 in fire tube 2 are totally or nearly totally closed, and they are opened more and more by the action of the return flexion of bimetal strips 20 as the temperature in the burner is increasing. This ensures always an optimal starting and burning behavior of the flame.

In specifically highly charged burner heads of this embodiment, it is appropriate to add a flame stabilizer, e.g. a flame holder ring 24, downstream of splash ring 5. This ring 24 which has a relatively small thickness, see FIG. 1, is mounted substantially perpendicularly to the longitudinal axis of the fire tube 2. The ring 24 is fixed by a number of mounting pins 24A—two of them being shown in FIG. 1—to the frontal, downstream surface of the splash ring 5 already described above.

The stability of the burning flame and, thus a more quiet and low-emission combustion may further be improved by additional flame stabilizers. These are flaps 23 which are fixed to or formed at the periphery of screen 10 (see also FIG. 2) and can be twisted about a reduced area connecting necks, similar to neck 25 towards the plane of screen 10. Two or more flaps 23 can be provided on the inner periphery of screen 10; the opening 10' may have any shape whatsoever, e.g. a circular, square (FIG. 2), hexagonal or otherwise polygonal shape or other. Further flame stabilizers 25 may be attached by reduced area necks 25' to splash ring 5, i.e. at its periphery that faces nozzle 4. The latter flame stabilizers 25 may also be inclined with respect to the ring surface of ring 5; one or more flame stabilizers may be provided.

FIG. 3 shows a front view of a nozzle plate comprising air passage openings 7 and 8 as well as the opening for fuel nozzle 4. This embodiment allows a very good access for flue gases which are radially recirculated from the outside to the center region; see arrows 15.

FIGS. 4 and 5 show another embodiment of the burner of the invention having a different shape of the air nozzles in nozzle plate 6, wherein the passage area of the nozzles may be changed from the outside, possibly automatically.

As it is known in this field of the art, burners, especially heating burners, must always be designed for the highest operational load. In order to enable a partial load operation, the burner must periodically be started and stopped since a reduced fuel supply does not allow a proper combustion and a stable flame in the fire tube due to the modified flowing conditions in the fire tube. Thus, higher noxious gas values are generated in the flue gas since the starting conditions of the burner are encountered more often.

The present invention avoids this serious disadvantage. The invention allows to modify the mass flow of the combustion air, thus allowing an adaptation to a reduced fuel supply. Furthermore, FIGS. 4 and 5 show a construction for directing the combustion air jets at an angle, normally a small angle, with respect to the longitudinal axis of fire tube 2. This results in a kind of a rotating turbulence within fire tube 2 for improving combustion. These two conditions, i.e. control of the mass flow of the combustion air, and the angular displacement of said air supply, are combined in FIGS. 4 and 5 in one illustration for the sake of simplicity. However, they are generally contemplated and realized separately.

According to FIGS. 4 and 5, a solid nozzle plate 6A corresponding to nozzle plate 6 in FIGS. 1 to 3 is secured inside fire tube 2, normally perpendicularly to its longitudinal axis. Nozzle plate 6A is provided with radial slots 32, and one edge 33 of each slot 32 is bent upwardly, i.e. towards the interior of said fire tube, at an angle $\alpha$ with respect to the longitudinal axis of fire tube 2. Said angle $\alpha$, normally 0°, generally amounts to only a few degrees, e.g. to 15° at the most.

Underneath nozzle plate 6A, an adjoining slot plate 6B is provided which is rotatable around the axis of burner nozzle 4 and has slots 34 aligned with slots 32 of nozzle plate 6A. The slots 34 are larger than the slots 32. The inner edge 35 of slots 34 is substantially parallel to edge 33 of plate 6A and is also bent towards the interior of fire tube 2 at an angle α, thus forming a slot nozzle 7A or 8A, as appears clearly in FIG. 5. By rotating slot plate 6B, the free area of slots 7A, 8A may be changed. Rotation of plate 6B may e.g. be achieved by a cam formed by rod 36 of circular cross-section mounted on eccentric pin 37 that is journalled in a bore of nozzle plate 6A. Cam rod 36 engages in a radial recess 38 of slot plate 6B and may be operated from the outside of the burner.

Slots 7A and 8A may only cover a portion of the cross-section of plate 6a in the radial direction or, as shown in FIG. 4, form a continuous ring 39 in the region of fuel nozzle 4. Consequently, in this embodiment, basically only one air admission nozzle is present; under the condition that the circumference of the nozzle opening, i.e. the free air passage area, is greater than the circumference of a circle having the same area. This condition must also be fulfilled in all embodiments of the burner having circular air nozzles, i.e. the sum of all circumferences of the nozzles must be greater than the circumference of an imaginary circle having an area which is equal to the sum of all areas of the nozzle cross-sections.

During operation of the burner of the invention, the mass flow of the fresh combustion air in partial zones of the region which is limited by fire tube 2 and the free area 10' of screen 10 and which extends downstream of the screen 10, is typically smaller than in the zones nearer to the longitudinal axis of the fire tube; this is ensured since nozzles 7 are larger than nozzles 8. However, the position of nozzles 7 and 8 may be interchanged, resulting in reversed flow conditions within the fire tube.

Nozzle 4 is preferably designed in such a way that a major part of the injected fuel, namely when a liquid is concerned, is evaporated and at least partially gasified within the above-described zone (i.e. the zone comprising the support means 11). Mixtures comprising fuel, recirculated flue gas and air having a fuel excess are formed in this zone. In more central zones of the fire tube, mixtures of flue gas, air and fuel having air excess are formed, and in this manner, a radial layering of the mixture composition is enforced which axially extends at least over a portion of the length of the fire tube.

It is preferred to conduct the air jets and the fuel jets in such a manner that a circumferential layering of zones with air excess and zones with air deficiency is formed. Air and fuel are advantageously conducted in such a manner that the central region of the fire tube is extensively filled with flue gas from the mentioned zone between the nozzle plate and the screen. This requires a central injection of the fuel, i.e. in the longitudinal axis of the fire tube.

The fuel supply means may be designed for only one fuel, for example natural gas, fuel oil, coal granules etc., or be adapted for an operation with two or more fuels, for example the combustion of natural gas or fuel oil and optionally natural gas and fuel oil together in equal parts, as it is in many cases desired with greater burners having a heating power above about 1 MW.

The drawing shows as an example two possible special arrangements of the ignition spark gaps X, namely at 30 and at 30'. It may be necessary, depending on the particular construction of the burner, to change and modify the position of the spark gap X. This is within the knowledge of the one skilled in the art and may be determined by simple tests.

Burner heads of the described kind have a good starting behavior, are mainenance-free and have a neglectable burning noise. The surprisingly simple construction is accompanied by an even more surprising, very low pollution and an extremely wide control range, and these features are very welcome to furnace constructors and burner service firms.

I claim:

1. A process for the continuous combustion of fluid fuels by air in a blast burner tightly mounted in a wall of a combustion chamber, said burner having a burner head comprising a generally cylindrical fire tube having at least one opening in its upstream wall region for recirculating combustion gases from said combustion chamber into said fire tube, fuel supply means comprising an axially mounted fuel injection nozzle from which fuel is emitted into said fire tube to flow generally axially of the latter, and ignition means, at least a substantial portion of combustion air being supplied to said burner head in the form of air jets through a nozzle plate within said fire tube, which generates said air jets, at least one low-pressure region in said fire tube being capable of aspirating flue gases in the manner of an injector pump, said process comprising the steps of:

(a) providing a screen that is mounted in said fire tube with a free passage area at its center that is greater than the sum of all passage areas defined by said air jets and blocking the flow of gases between said free passage and said fire tube directing said air jets through said free passage and positioning said screen to stabilize said low pressure region;

(b) preventing fuel that is introduced into the fire tube from impinging directly upon surface portions of said screen that face upstream toward said nozzle plate; and (c) aspirating flue gases from the space surrounding said fire tube into said fire tube at a location upstream of said screen.

2. The process of claim 1 also comprising the step of automatically controlling the amount of the aspirated flue gas that enters said fire tube at said location upstream of said screen.

3. The process of claim 1 also comprising the steps of:

controlling mass flow of combustion air within said fire tube in a manner such that said mass flow of combustion air is smaller in partial zones of the region limited by said fire tube and the free area of said screen and extending downstream of said screen, than in regions closer to the central axis of said fire tube;

evaporating a major part of the injected fuel and at least partially gasifying a major part of the injected fuel downstream of the screen free area, resulting in the formation of mixtures comprising fuel, recirculated flue gas and air with excess fuel; and in more central regions, forming mixtures of flue gas, air and fuel with excess air so that a radial layering of the mixture composition extends axially over at least a partial length of the fire tube.

4. The process of claim 1 also comprising the step of controlling air and flue gas in a manner such that the central region of said fire tube, from the region between said nozzle plate and said screen, is filled extensively with flue gas.

5. The process of claim 1 also comprising the steps of:

utilizing liquid fuel and directing same towards a splash ring disposed downstream of said screen; and vaporizing and partially gasifying a substantial part of the fuel on said splash ring.

6. A device for continuous combustion of fluid fuels, said device comprising:

a blast burner tightly mounted in a wall of a combustion chamber, said burner including a burner head and a generally cylindrical fire tube having opening means in the wall region of its upstream end for recirculating combustion gases from said combustion chamber;

fuel supply means comprising an axially mounted fuel injection nozzle having a fuel outlet at its downstream end;

a nozzle plate within said tube having air jet nozzles for the supply of combustion air, said fuel outlet being disposed at the downstream side of said nozzle plate;

ignition means for firing a mixture that includes combustion air and fuel emitted from said fuel outlet;

said device further comprising a screen downstream of said nozzle plate and spaced therefrom, said screen being disposed entirely within said fire tube;

said screen being operatively mounted in said fire tube and having a central opening means downstream of said nozzle plate, said opening means defining a free passage area greater than the sum of all free air passage areas of said air jet nozzles in said nozzle plate and said screen blocking the flow of gases between said central opening and said fire tube;

said fuel injection nozzle being disposed so that fuel emitted thereby does not impinge on the upstream side of said screen during normal burner operation but passes through said central opening means, said air jet nozzle directing air through said central opening of said screen; and said opening means in the wall region of said fire tube being disposed between said nozzle plate and said screen in operative position to aspirate flue gas into the space between said nozzle plate and said screen.

7. The device of claim 6, further comprising closure means for more or less obturating said wall opening means in said wall region of said fire tube in order to modify a free passage area for aspirated flue gases and thus their inflow rate.

8. The device of claim 7, further comprising control means cooperating with said closure means in a manner such that said free passage area increases as the temperature of said aspirated flue gases increases.

9. The device of claim 7 wherein said closure means includes a flat ring axially slidingly engaged in said fire tube, said ring being adapted to more or less obturate said passage area from the interior of said fire tube in order to control the amount of aspirated flue gas, and a plurality of bimetal strips each connected between said ring and said nozzle plate.

10. The device of claim 9, further comprising control means cooperating with said closure means in a manner such that said free passage area increases as the temperature of said aspirated flue gases increases.

11. The process of claim 2, wherein the amount of aspirated flue gas is controlled in such a manner that its amount increases with increasing temperature.

12. The device of claim 6, including means for adjusting the free air passage area of said air supply nozzles.

13. The device of claim 6, wherein said air supply nozzles are slot nozzles.

14. The device of claim 13, wherein the axis of said air supply nozzles includes and angle of from 0 to about 15 degrees with respect to the longitudinal axis of said fire tube.

15. The device of claim 6, further comprising flap shaped flame stabilisers in the region of said screen.

16. The device of claim 6, wherein said nozzle plate is provided with pipe sockets extending into said fire tube.

17. The device of claim 6, wherein said air jet nozzles and said fuel injection nozzle are arranged such as to generate a circumferential layering within said fire tube into zones having air deficiencies and zones having excess air.

18. The device of claim 6, further comprising a splash ring downstream of said screen, said splash ring being arranged within said fire tube concentrically with respect to said fuel supply means, so that a substantial part of the fuel impinges on the splash ring and is evaporated and partially gasified on its surfaces.

19. The device of claim 18, further comprising at least one flame stabilizer connected to said splash ring.

20. The device of claim 19, wherein said flame stabilizer comprises a plurality of flaps distributed over the circumference of said splash ring, said flap stabilizers being fixed to and twistable with respect to said splash ring.

* * * * *